US005146193A

United States Patent [19]

Sokola

[11] Patent Number: 5,146,193

[45] Date of Patent: Sep. 8, 1992

[54] MONOLITHIC CERAMIC FILTER OR DUPLEXER HAVING SURFACE MOUNT CORRECTIONS AND TRANSMISSION ZEROES

[75] Inventor: Raymond L. Sokola, Albuquerque, N. Mex.

[73] Assignee: Motorola, Inc., Schaumburg, Ill.

[21] Appl. No.: 661,025

[22] Filed: Feb. 25, 1991

[51] Int. Cl.[5] ..... H01P 1/202; H04B 1/50

[52] U.S. Cl. ..... 333/206; 333/134; 455/78

[58] Field of Search ..... 333/202, 206, 207, 219, 333/134, 222; 370/24, 30, 32; 455/78

[56] References Cited

U.S. PATENT DOCUMENTS

| | | | |
|---|---|---|---|
| Re. 32,768 | 10/1988 | D'Avello et al. | 333/207 |
| 4,432,977 | 2/1984 | Sokola | 333/206 |
| 4,673,902 | 6/1987 | Takeda et al. | 333/206 X |
| 4,692,726 | 9/1987 | Green et al. | 333/206 |
| 4,716,391 | 12/1987 | Moutrie et al. | 333/206 |
| 4,742,562 | 5/1988 | Kommrusch | 455/78 |
| 4,823,098 | 4/1989 | DeMuro et al. | 333/202 |
| 4,829,274 | 5/1989 | Green et al. | 333/202 |
| 4,879,533 | 11/1989 | de Muro et al. | 333/206 |
| 4,890,079 | 12/1989 | Sasaki | 333/206 |
| 4,896,124 | 1/1990 | Schwent | 333/202 |
| 4,937,542 | 6/1990 | Nakatuka | 333/202 |
| 4,965,537 | 10/1990 | Kommrusch | 333/202 |
| 5,045,824 | 9/1991 | Metroka | 333/202 X |

FOREIGN PATENT DOCUMENTS

| | | | |
|---|---|---|---|
| 0119901 | 7/1984 | Japan | 333/202 |
| 0043904 | 2/1987 | Japan | 333/202 |

*Primary Examiner*—Eugene R. LaRoche
*Assistant Examiner*—Seung Ham
*Attorney, Agent, or Firm*—Joseph P. Krause

[57] ABSTRACT

A ceramic filter (10) can be surface mounted. Input-/output pads (18 and 20) through which electrical signals pass are located on one surface of a block of dielectric material (12) to permit use of the so-called surface mount manufacturing techniques. No wired connections to the ceramic bandpass filter block are required.

49 Claims, 1 Drawing Sheet

MONOLITHIC CERAMIC FILTER OR DUPLEXER HAVING SURFACE MOUNT CORRECTIONS AND TRANSMISSION ZEROES

FIELD OF THE INVENTION

The present invention relates generally to electrical filters, and relates particularly to so-called ceramic filters.

BACKGROUND OF THE INVENTION

Ceramic filters are well known in the art and at least one is described in U.S. Pat. No. 4,431,977 for a "Ceramic Bandpass Filter". Prior art ceramic bandpass filters are at least partially constructed from blocks of ceramic material, are relatively large and are typically coupled to other electronic circuitry through discrete wires, cables, and pins attached or coupled to connection points on external surfaces of the blocks.

It is also well known that some major objectives in electronic designs are reduced physical size, increased reliability, improved manufacturability and reduced manufacturing cost. To achieve these somewhat conflicting objectives, electronic circuits are increasingly being manufactured using so-called surface-mount techniques. Surface-mount is a manufacturing technique by which electronic components are attached to a circuitry substrate or circuit board without using metallic leads that extend from a package or electronic component. Small connection nodes on typically only one side of a greatly reduced size package, are electrically joined to corresponding connection nodes on a substrate or circuit board by either a wave soldering or reflow soldering technique. The registration, or alignment, of the connection nodes on the component with the connection nodes on the circuit board or substrate must be carefully maintained during assembly. Eliminating connection leads on electronic components and using surface mount techniques permits great reductions in the physical size of an electronic circuit and a significant increase in its reliability by reducing a significant source of electrical failures.

While prior art ceramic bandpass filters clearly outperform lumped element filters, (i.e. filters comprised of inductors, capacitors and perhaps resistors), particularly in high-frequency applications, (above 200 MHz.) a ceramic filter having reduced physical size while being surface mountable would be an improvement over the prior art.

SUMMARY OF THE INVENTION

There is disclosed a ceramic filter incorporating a passband and one or more transmission zeroes, the preferred embodiment of which is constructed of a rectangular block of dielectric ceramic material, that has both reduced physical size and that can be surface mounted. With the exception of one external surface of the ceramic block through which two included through-holes extend, and, with the exception of a portion of one other side or lateral surface of the block upon which connection nodes are located, all external surfaces of the block filter, including surfaces of the block within the through holes are coated with a conductive material (metallized). The metallized external surfaces of the block and the metallized internal surfaces of the through holes, which have a predetermined length, form transmission lines shorted at one end. In the preferred embodiment, these shorted transmission lines have an electrical length substantially equal to one (or an odd-number multiple of) quarter the wavelength of an electrical signal of a particular frequency that is desired to pass through the filter. The input output pads are located within an unmetallized area on one lateral side of the block and are pads or areas of conductive material capacitively coupling to the metallized through-hole surfaces.

Side-located input output pads or connection nodes permit connection of the filter to a substrate or carrier using surface mount manufacturing techniques. Proper selection of the ceramic material permits electrical characteristics to be maintained while the physical size of the block is reduced. No wire connection to the input and output pads is required.

DETAILED DESCRIPTION

Figure 1:
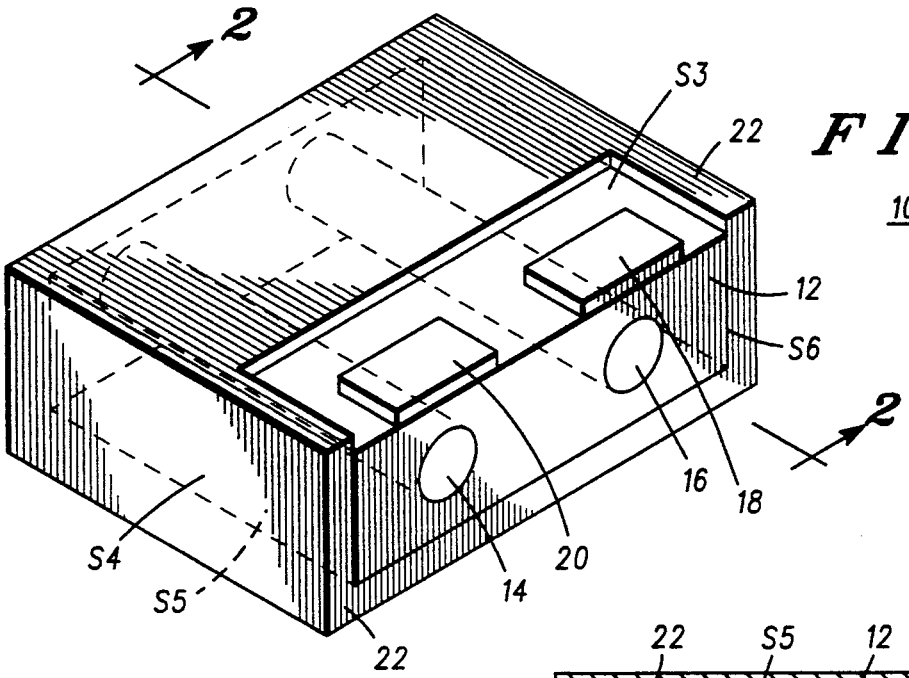
FIG. 1 shows an isometric perspective view of a surface mountable ceramic bandpass filter.

FIG. 1, shows an isometric view of a surface mountable dielectric filter (10). (What appears in FIG. 1 as the top or upper surface of the filter is actually the bottom or lower side (S3) of the block to more clearly show features of this side.) The ceramic bandpass filter (10) shown in FIG. 1 is comprised of a block of dielectric material (12), (shown in cross-section in FIG. 2) having a length L, the external surfaces of which (except for two surfaces) are entirely coated with an electrically conductive material (22).

The block (12) shown in FIG. 1 includes two through holes (14 and 16) that are void cylindrical volumes through the block of material (12). The holes (14 and 16) extend through a first or top surface (shown as S1 in FIG. 2), through the block of material (12) and through a second or bottom surface (S2 shown in FIG. 2).

Figure 2:
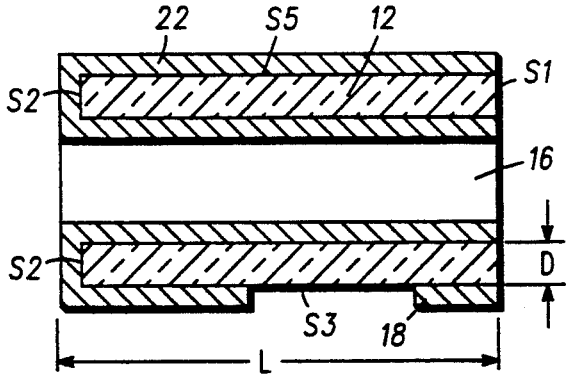
FIG. 2 shows a cross-sectional view along lines 2—2 shown in FIG. 1.

The external surfaces (S1-S6) of the dielectric block (12), with the exception of the top surface S1 and a portion of the side surface S3, are coated with a conductive material (22). Additionally, the internal surfaces of the block within the through holes (14 and 16) are also coated with conductive material (22). (The coverage of the metallization on the surfaces of the block can be seen in better detail in FIG. 2. FIG. 2 shows that the conductive material, (22) which is also on the internal surfaces of the through holes, extends completely through one end of the holes (the end near side S2) and is electrically continuous with the plating material on the external surfaces of the block 12.)

The block of material (12) comprising the filter (10) has a predetermined length, L, which in the preferred embodiment was substantially equal to one-quarter the wavelength of the desired nominal or center pass-band frequency of the filter. The holes (14 and 16) shown in the figures can be considered to have longitudinal axes (running the length of the holes) at their geometric centers that are substantially perpendicular (orthogonal) to geometric planes in which the first and second ends (S1 and S2) can be considered to lie. When the through holes are perpendicular to the first and second ends, (S1 and S2) the through holes will of course have a physical length substantially equal to L, the length of the block. The physical length of the hole (L) will of course affect the electrical length of a transmission line formed by the metallization of the surfaces of the holes.

The plated through holes (14 and 16), the plating of which at the unmetallized first end (the S1 end) is open circuited and which at the second end (the S2 end) is electrically connected to the metallization on the remaining sides of the block, electrically form transmission lines short circuited (to the metallization on the external surfaces of the block (12) at their S2 ends and open circuited at their S1 ends. These shorted transmission lines, when properly used as band pass filter elements, will pass to the band pass filter output, only those electrical signals input to the filter that have quarter wavelengths substantially equal to the electrical length of the shorted transmission lines. Signals coupled into the shorted transmission lines the quarter-wavelengths of which are substantially different than the electrical length of the shorted transmission lines will be attenuated. Alternatively, if the electrical length of the shorted transmission lines is substantially equal to an odd number of quarter-wavelengths of signals input to the filter (10), the filter (10) will pass these signals substantially unattenuated as well.

Electrical signals are coupled into and out of the shorted transmission lines through input output connection pads or connection nodes (18 and 20) shown in FIG. 1. These connection pads (18 and 20) are typically relatively small areas of conductive material, deposited on one side of the block of material (12) in an unmetallized region on the bottom surface (S3) that are used to surface mount the filter (10) to a circuit board or other substrate. By their positions relative to the holes (14 and 16) as seen in FIG. 1, the connection pads (18 and 20) (hereafter referred to as input output pads) can be considered to be adjacent to the holes (14 and 16). One pad, 18 for instance, might be considered to be adjacent hole 16 whereas the other pad, 20, might be considered adjacent to hole 14.

In the preferred embodiment of a two-pole filter, which is as shown in FIG. 1, the relative position of the input output pads (18 and 20) with respect to the first surface (S1) and geometric center axes of the through holes (14 and 16) is substantially as shown. Capacitive coupling between the input output pads (18 and 20) and the transmission lines, formed by the metallized surfaces of the through holes (14 and 16), is determined at least in part by the dielectric constant of the ceramic material comprising the block (12), the area of the input output pads (18 and 20), and the separation distance (D) between the through holes (14 and 16) and the input/output pads (18 and 20). (The separation distance (D) between the input/output pads (18 and 20) and the through holes is established by the thickness of the ceramic material between the through holes (14 and 16) and the input/output pads (18 and 20).)

Electrical characteristics of the bandpass filter (10) shown in FIG. 1, (as well as electrical characteristics of the alternate embodiments of the filter discussed herein), including for example center, or resonant frequency, input and output impedance, and bandwidth are established in large part by physical dimensions of the block (12). Resonant frequency is largely established by the length, L, of the block (12), as well as the length of the metallization within the through holes (14 and 16) (Metallization may not extend completely through the entire length of the holes, effectively shortening the electrical length of the transmission line). Input and output impedances are established by the diameters of the through holes (14 and 16), distance from the through hole to the side S3 and dimensions and placement of the input-output pads (18 and 20). Bandwidth of the filter (10) can be altered by changing the distance between the transmission lines, as well as altering the cross-section of the holes and or the metallization on the external sides of the filter.

The filter (10) shown in FIG. 1 described above has a frequency response with at least one transmission zero at a frequency $F_z$ produced by the cancellation of the electric and magnetic fields associated with the two transmission lines. Since in the embodiment shown in FIG. 1 there is very little top loading of the resonators, the frequency at which the electric and magnetic field couplings cancel will occur very close to the passband. This frequency $F_z$ is also controlled by varying the pattern of conductive material on the input/output side of the block as well as the geometry of the block and the resonator holes. Poles, which in the embodiment shown are typically above the frequency of the zero ($F_z$), are established in part by reducing the effective electrical length of the transmission lines which is accomplished by removing conductive material from the metallization of the block in the areas surrounding the input-output pads. (The metallization removed from side S3 surrounding the input-output pads.) Removing this material decreases capacitive loading on the transmission lines, increasing the resonant frequency of the transmission lines ($F_o$) above the frequency ($F_z$) at which the electric and magnetic fields cancel.

In the preferred embodiment of the filter (10) the block of material (12) was a ceramic compound having a relatively high Q factor. This dielectric material might be selected from any high Q microwave ceramics, including families of materials such as barium oxide, titanium oxide, and zirconium oxide. The material is typically pressed to form a block with included holes, fired at a high temperature, and then plated with a conductive material. The plating used on the block (12) may be any appropriate conductive material such as copper or silver. All six sides of the dielectric block material (12) are metallized with the exception of the top or upper surface S1 and a portion of the side surface S3. The unmetallized portion of the side surface S3 substantially surrounds the input/output pads (18 and 20).

While the preferred embodiment of the invention is substantially as shown in FIG. 1, wherein the shape of the dielectric block is a parallelpiped, other embodiments of a surface mountable dielectric block filter might include a substantially cylindrical block of material through which through holes extend and which includes a single flattened side where the input/output pads (18 and 20) may be located. Still other embodiments might contemplate blocks having hexagonal or triangular cross-sectional shapes. Any of these alternate shapes of the block (12) might have different electrical characteristics.

Similarly, the through holes (14 and 16) while shown in the figures as having substantially circular cross-sectional shapes, alternate embodiments of the invention might contemplate plated through holes (14 and 16) that have other cross-sectional shapes, shapes other than circular cross-sections.

Figure 3:
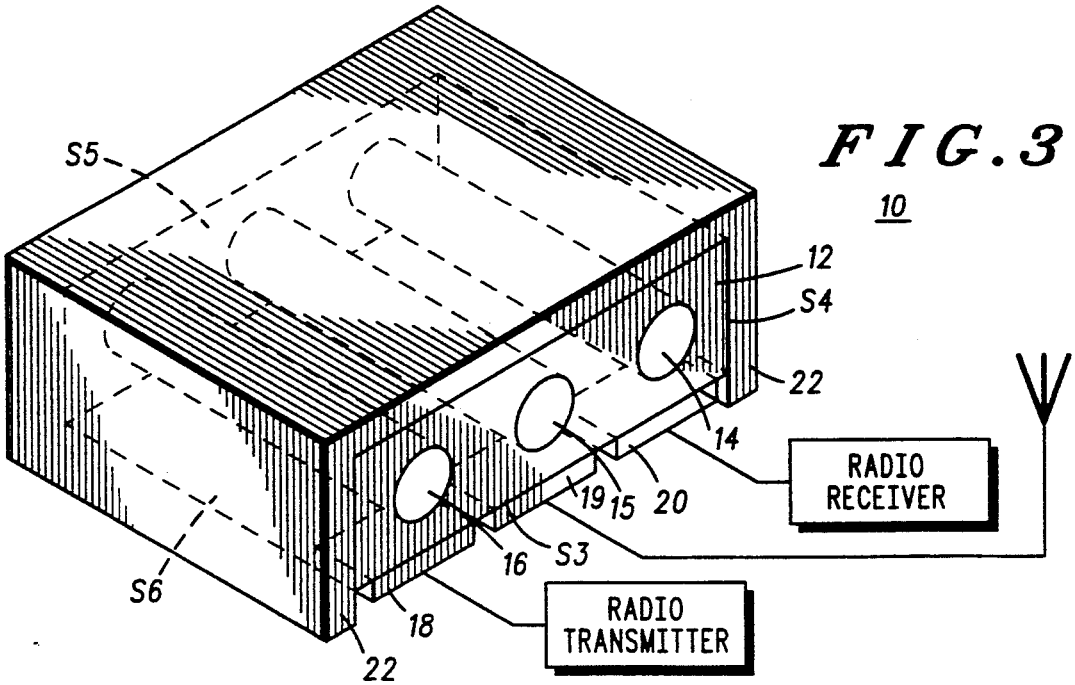
FIG. 3 shows an isometric perspective view of an alternate embodiment of the filter of FIG. 1 used as a duplexer.

Other embodiments of a band pass filter contemplated herein would include ceramic blocks having more than two holes in more than one transmission zero. Such alternate embodiments would include ceramic blocks (12) with possibly three or more internally metallized holes (14, 15, and 16 as shown in FIG. 3), each constructed substantially as described above. (Each metallized hole would comprise a short-circuited coaxial resonator.) A block filter having more than two holes would likely have the two input-output pads described above adjacent to the first and last holes, although the input-output pads might be placed adjacent to virtually any two holes in the block. Still other embodiments of block filters with more than two holes would also include using more than just two input-output pads. Three or more input-output pads might be placed in an unmetallized area of a side of the block to which electrical connections could be made.

FIG. 3 shows a block filter (10) with three resonators (shorted transmission lines) (14, 15, and 16) with three input-output pads (18, 19, and 20) that could also be used as a duplexer for a radio communications device if the third input output pad (19) is properly positioned as a common input-output connection for two filters (each filter comprised of at least two of the three shorted-coaxial transmission lines) sharing the third input-output pad as a common input output connection. Such a duplexer could be used to separate and/or combine electrical signals by frequency.

Referring to FIG. 3, a third input-output pad (19) is shown located between the first and second input-output pads, adjacent (proximate or close) to a third resonator (15) and substantially adjacent to the top surface (S1). (FIG. 3 shows the block filter as seen from the top side, S5.) In the block filter shown in FIG. 3, the first input-output pad (18) and third input-output pad (19) couple signals substantially through the first and third resonators (16 and 15 respectively) that together comprise a first bandpass filter in the ceramic block shown in FIG. 3. The second input-output pad (20) and third input-output pad (19) couple electrical signals substantially through the second and third resonators (14 and 15 respectively) that together comprise a second bandpass filter in the ceramic block shown in FIG. 3. These first and second bandpass filters shown in FIG. 3 do act as bandpass filters but also share a common input-output terminal, input-output pad 19. In most duplexer applications, these two bandpass filters will usually have different center frequencies each for passing only those signals having frequencies at or near their respective center frequencies.

Referring to FIG. 3, when operating as a duplexer, if radio frequency signals are impressed on the third input-output pad (19) and if the first and second filters have different center frequencies, the first and second bandpass filters will pass to the first and second input-output pads, (14 and 18) respectively, only those radio frequency signals on pad 19 having center frequencies substantially equal to the center frequencies of the filters. In such an application, the duplexer shown in FIG. 3 can split a signal on the third input-output pad (19) into at least two different frequency components, the components of which appear at either the first input-output pad (18) or the second input output pad (20). A radio frequency signal on pad 19 to be split into components might originate from a radio transmitter device with the two bandpass filters (one filter comprised of resonators 16 and 15 and the other filter comprised of resonators 15 and 14) separating signals from the transmitter device into different frequency components that are coupled to different antennas for broadcast. Alternatively, a radio frequency signal on pad 19 might originate from a radio antenna device, such as is shown in FIG. 3, with the two bandpass filters separating received radio frequency signals into different frequency components that are coupled to different receivers that might be coupled to pads 18 and 20.

In addition to separating electrical signals according to frequency, the duplexer shown in FIG. 3 can be used to add, or combine, different frequency signals at the first and second input-output pads (18 and 20) to the third input-output pad (19) as well. If different radio frequency signals from two different radio signal sources are impressed on the first and second input pads (18 and 20), and if these signals have first and second center frequencies corresponding to the center frequencies of the filters, the two filters will combine the two signals and pass them to the third input-output pad (19). In such an application, the radio frequency signals on the first and second input-output pads (18 and 20) might originate from two different frequency radio transmitters the outputs of which are combined and appear together on pad 19 for subsequent broadcast on an antenna. Pad 19 might be coupled to such an antenna device. The two different radio frequency signals on pads 18 and 20 might also originate from two different antenna devices the signals from which are combined by the filter (10) operating as a duplexer and appear together on pad 19 to which one or more radio receiver devices might be coupled.

In most applications for a duplexer, if the third input-output pad (19) is coupled to a single antenna for a two-way radio communications device and if the first filter (comprised of the first and third resonators 16 and 15) has a first center frequency different from the center frequency of the second filter (comprised of the second and third resonators 14 and 15 and having a second center frequency) the three-hole block readily permits full-duplex communications.

If the third input-output pad is coupled to an antenna for a two-way, full-duplex, radio communications device having transmitter and receiver portions that operate simultaneously albeit at different frequencies in a full-duplex mode, (i.e. the receiver may be receiving signals at $f_1$ while the transmitter is transmitting signals at $f_2$), one filter section of the duplexer shown in FIG. 3 (the receiver filter) would permit the receiver section to receive only the $f_1$ signals from the antenna while suppressing from the receivers input, $f_2$ signals from the transmitter. The second filter section of the duplexer (the transmitter section) would permit only $f_2$ signals from the transmitter to be coupled to the antenna. Stated alternatively, if one filter section (comprised of resonators 16 and 15 for example) has a center frequency corresponding to the transmitter frequency of the communications device and if the other filter section (comprised of resonators 14 and 15) has a center frequency corresponding to the receiver frequency of the communications device, the receiver's filter section will prevent signals from the transmitter from reaching the receiver. The transmitter's filter section will prevent signals on the antenna that are outside the transmit band and which might mix with signals in the transmitter, possibly generating unwanted spurious signals from reaching the transmitter. The transmit filter also eliminates noise and other spurious signals from the transmitter output signal that might interfere with the receiver.

Those skilled in the art will of course recognize that the filter shown in FIG. 3 can be used to separate a source of signals at pad 19 into two different frequency components that would appear at pads 18 and 20. Such a source of signals might be a single antenna coupled to pad 19 for example. Such a source of signals on pad 19 might also include one or more transmitters signals from which are to be split to antennas coupled to pads 18 and 20.

The filter could also be used to combine two different frequency signals on pads 18 and 20 into one signal at pad 19. Such signals to be combined might originate from two transmitters (coupled to pads 18 and 20) to be coupled to a single antenna coupled to pad 19. Signals from pads 18 and 20 to be combined might also originate from two antennas coupled to pads 18 and 20 combined in the filter for a single radio device coupled to pad 19.

The filter shown in FIG. 3, when used as a duplexer, can be used in virtually any topology which will of course depend upon the application of the device. A source of electrical signals might be coupled to any one (or two) of the three input-output pads (18, 19, or 20) with the other two (or one) pads being coupled to the destination for the signals. A destination for signals might also be coupled to any one (or two) of the input-output pads with a source of signals being coupled to the other two (or one) input-output pads.

Still other embodiments of the filter shown in the figures would contemplate adding multiple resonators (three or more), to block structures having only two input output pads as well adding multiple resonators to blocks having three or more input-output pads wherein the third input-output pad is coupled to more than one of the plurality of resonators. If the surface area of the third input output pad (19) is increased such that it is relatively close to more than one resonator, the coupling between the third input-output pad (19) and the various resonators will affect the response of a filter or duplexer accordingly.

I claim:

1. A filter including a passband and at least one transmission zero for passing desired frequency electrical signals comprising:

a filter body comprised of a block of dielectric material having a first predetermined physical length, said first predetermined length being substantially equal to one-fourth the wave length of said desired frequency signals, substantially planar top and bottom surfaces and having at least one planar side surface, said planar side surface having a predetermined physical length substantially equal to one-fourth the wave length of said desired frequency signals, said filter body having at least first and second holes extending through the top and bottom surfaces, having center axes, and having substantially constant predetermined cross-sectional shapes between said top and bottom surfaces said holes spatially disposed at a predetermined distance from one another;

first input-output pad comprised of an area of conductive material disposed on said side surface;

second input-output pad comprised of an area of conductive material disposed on said side surface;

said filter body and interior surfaces of said first and second holes being substantially covered with a conductive material with the exception of a predetermined first uncoated area on said side surface surrounding said first and said second input-output pads on said side surface and with the additional exception of said top surface, said coated interior surfaces of said first and second holes and said coated filter body forming first and second shorted coaxial resonators respectively having first and second electrical lengths, said first and second input-output pads being capacitively coupled to said first and said second shortened coaxial resonators.

2. The filter of claim 1 where said filter body is comprised of a block of dielectric material having the shape of a parallelpiped.

3. The filter of claim 1 where said first and second holes have circular cross-sectional shapes.

4. The filter of claim 1 where said first and second holes have substantially parallel center axes.

5. The filter of claim 1 where said first input-output pad is an area of conductive material substantially adjacent to said top surface of said filter body within said first uncoated area.

6. The filter of claim 1 where said second input-output pad is an area of conductive material substantially adjacent to said top surface of said filter body within said first uncoated area.

7. The filter of claim 1 where said first and second predetermined distances are substantially equal.

8. The filter of claim 1 including at least one additional hole and at least one additional transmission zero, said at least one additional hole being positioned substantially between said first and second holes and extending through the top and bottom surfaces, spatially disposed at predetermined distances from said first and second holes, surfaces of said block within said at least one additional hole being substantially covered with a conductive material electrically coupled to conductive material covering said block of material and forming a shorted coaxial resonator.

9. The filter of claim 8 where said first and second input-output pad are substantially adjacent to said first and second holes respectively.

10. The filter of claim 8, where at least one of said first and second input-output pads are substantially adjacent to said first and said at least one additional hole.

11. The filter of claim 8 further including at least a third input-output pad between said first and second input-output pads and substantially adjacent to said top surface of said filter body means within said first uncoated area.

12. The filter of claim 8 where said third input-output pad is substantially adjacent said third shorted coaxial resonator and positioned at a predetermined location between said first and second input-output pads such that said first and third input-output pads substantially couple signals through said first and third resonators thereby forming a first filter, said second and third input-output pads coupling signals substantially through said second and third resonators forming a second filter, said first and second filters having first and second center frequencies respectively.

13. The filter of claim 12 where said first center frequency is substantially equal to the center frequency of a radio communications device transmit frequency.

14. The filter of claim 12 where said second center frequency is substantially equal to the center frequency of a radio communications device receive frequency.

15. The filter of claim 12 where said third input-output pad is coupled to a source of radio communications signals.

16. The filter of claim 12 where said third input-output pad is coupled to a source of radio communications signals comprised of at least first and second frequency signal components, and where said first and second input-output pads are coupled to first and second radio communications signal destinations.

17. The filter of claim 12 where said first and second input-output pads are coupled to first and second sources of radio communications signals and where said third input-output pad is coupled to a destination for radio communications signals.

18. The filter of claim 12 where said first center frequency is substantially equal to the center frequency of a radio communications device transmit frequency, said second center frequency is substantially equal to the center frequency of a radio communications device receive frequency and where said third input-output pad is coupled to a source of radio communications signals.

19. The filter of claim 1 including a plurality of additional holes, said plurality of additional holes being positioned substantially between said first and second holes and all extending through the top and bottom surfaces, spatially disposed at predetermined distances from each other and from said first and second holes, surfaces of said block within said plurality of additional holes being substantially covered with a conductive material electrically coupled to conductive material covering said block of material and forming a plurality of shorted coaxial resonators.

20. The filter of claim 17 further including at least a third input-output pad between said first and second input-output pads and substantially adjacent to said top surface of said filter body means, said third input-output pad being electrically coupled to a plurality of said additional holes and being located within said first uncoated area.

21. The filter of claim 1 where said first and second electrical lengths are odd-numbered multiples of one-quarter wavelengths of said desired frequency signals.

22. A filter comprising:

a block of dielectric material having a first predetermined physical length, at least top and bottom substantially planar surfaces and at least one planar side surface, said planar side surface also having a predetermined physical length substantially equal to said first predetermined physical length and being substantially orthogonal to said top and said bottom surfaces said block of dielectric material having at least first and second through holes each having center axes that are substantially orthogonal to the top and bottom surfaces, said through holes extending through the top and bottom surfaces and having substantially constant cross-sectional shapes throughout the length, spatially disposed at a predetermined distance from one another;

first input-output pad comprised of a substantially planar area of conductive material disposed on said side surface at a first predetermined distance from said center axis of said first hole in a block of dielectric material at a second predetermined distance from the plane in which said top surface lies;

second input-output pad comprised of a substantially planar area of conductive material disposed on said side surface at a third predetermined distance from said center axis of said second hole in the block of dielectric material and at a fourth predetermined distance from the plane in which said top surface lies;

said block of dielectric material and interior surfaces of said first and second holes being covered with a substantially continuous layer of conductive material, with the exception of a predetermined area surrounding said first and said second output pads and with the additional exception of said top surface, said coated interior surfaces of said first and said second holes and said coated dielectric block forming first and second shorted coaxial resonators having corresponding first and second electrical lengths, said first and said second input-output pads being capacitively coupled to said first and second shorted coaxial resonators.

23. The filter of claim 22 where said first and third predetermined distances are substantially equal and are established by the thickness of the dielectric material between said first and second input-output pads and the first and second through holes.

24. The filter of claim 22 where said second and fourth predetermined distances are substantially equal.

25. The filter of claim 22 where said first and second electrical lengths are odd-numbered multiples of one-quarter wavelengths of said desired frequency signals.

26. The filter of claim 22 including at least one additional hole, said at least one additional being positioned substantially between said first and second holes and extending through the top and bottom surfaces, spatially disposed at predetermined distances from said first and second holes, surfaces of said block within said at least one additional hole being substantially covered with a conductive material electrically coupled to conductive material covering said block of material and forming a shorted coaxial resonator.

27. The filter of claim 26 where said first and second input-output pad are substantially adjacent to said first and second holes respectively.

28. The filter of claim 26, where at least one of said first and second input-output pads are substantially adjacent to said first and said at least one additional hole.

29. The filter of claim 26 further including at least a third input-output pad between said first and second input-output pads and substantially adjacent to said top surface of said filter body means within said first uncoated area.

30. The filter of claim 26 where said third input-output pad is substantially adjacent to said third shorted coaxial resonator and positioned at a predetermined location between said first and second input-output pads such that said first and third input-output pads substantially couple signals through said first and third resonators thereby forming a first filter, said second and third input-output pads coupling signals substantially through said second and third resonators forming a second filter, said first and second filters having first and second center frequencies respectively.

31. The filter of claim 26 where said third input-output pad is coupled to a source of radio communications signals comprised of at least first and second frequency signal components, and where said first and second input-output pads are coupled to first and second radio communications signal destinations.

32. The filter of claim 29 where said first and second input-output pads are coupled to first and second sources of radio communications signals and where said third input-output pad is coupled to a destination for radio communications signals.

33. The filter of claim 30 where said first center frequency is substantially equal to the center frequency of a radio communications device transmit frequency.

34. The filter of claim 30 where said second center frequency is substantially equal to the center frequency of a radio communications device receive frequency.

35. The filter of claim 30 where said third input-output pad is coupled to a source of radio communications signals.

36. The filter of claim 30 where said first center frequency is substantially equal to the center frequency of a radio communications device transmit frequency, said second center frequency is substantially equal to the center frequency of a radio communications device receive frequency and where said third input-output pad is coupled to a source of radio communications signals.

37. The filter of claim 22 including a plurality of additional holes, said plurality of additional holes being positioned substantially between said first and second holes and all extending through the top and bottom surfaces, spatially disposed at predetermined distances from each other and from said first and second holes, surfaces of said block within said plurality of additional holes being substantially covered with a conductive material electrically coupled to conductive material covering said block of material and forming a plurality of shorted coaxial resonators.

38. The filter of claim 37 further including at least a third input-output pad between said first and second input-output pads and substantially adjacent to said top surface of said filter body means, said third input-output pad being electrically coupled to a plurality of said additional holes and being located within said first uncoated area.

39. A filter comprising:

a block of dielectric material having a first predetermined physical length, at least top and bottom substantially planar surfaces and a plurality of planar side surfaces, each planar side surface having a predetermined physical length substantially equal to said first physical length and being substantially orthogonal to said top and said bottom surfaces, said block of dielectric material having at least first and second substantially constant diameter circular cross-section through holes each having center axis, said through holes extending through the top and bottom surfaces, spatially disposed at as predetermined distance from one another and from said plurality of substantially planar side surfaces;

first input-output pad comprised of an area of conductive material disposed on a first substantially planar side surface at a first predetermined distance from said center axis of said first through hole and a second predetermined distance from said top surface;

second input-output pad comprised of an area of conductive material disposed on a first substantially planar side surface at a third predetermined distance from said center axis of said second through hole and a fourth predetermined distance from said top surface, said first and second input-output pads being separated from each other by a fifth predetermined distance;

said block of dielectric material and interior surfaces of said first and second holes being covered with a continuous layer of conductive material, with the exception of a predetermined area surrounding both said first and second input-output pads and with the exception of said top surface, said coated interior surfaces of said first and second pads and said coated dielectric block forming first and second shorted coaxial resonators having first and second electrical lengths respectively, said first and second input-output pads being capacitively coupled to said first and second shorted coaxial resonators.

40. The filter of claim 39 where said first and second electrical lengths are odd-numbered multiples of one-quarter wavelengths of said desired frequency signals.

41. A surface mountable duplexer for electrical signals comprising:

a block of dielectric material having a first predetermined physical length, substantially planar, top and bottom surfaces and at least one planar side surface, said planar side surface having a predetermined physical length substantially equal to said first predetermined physical length said block of dielectric material having a first, second, and third holes, each having center axis, predetermined cross-sectional shapes constant throughout their length and sizes, extending through the top and bottom surfaces, spatially disposed at a predetermined distance from one another;

first input-output pad comprised of an area of conductive material disposed on said side surface at a first predetermined distance from the center axis of said first hole in the block of dielectric material;

second input-output pad comprised of an area of conductive material disposed on said side surface at a second predetermined distance from the center axis of said second hole in the block of dielectric material;

third input-output pad comprised of an area of conductive material disposed on said side surface at a third predetermined distance from the center axis of said third hole in the block of dielectric material, said third input-output pad being located between said first and second input-output pads and substantially adjacent to said third hole;

said block of dielectric material and interior surfaces of said holes being substantially covered with a conductive material with the exception of a predetermined first uncoated area surrounding said input-output pads on said one side and with the exception of said top surface, said coated interior surfaces of said holes and said coated filter body forming first, second and third resonators thereby forming first and second filters sharing said third input-output pad as a common input-output pad, said input-output pads being capacitively coupled to said shorted coaxial resonators.

42. The duplexer of claim 41 where said block of dielectric material is comprised of a block of dielectric material having the shape of a parallelpiped.

43. The duplexer of claim 41 where said holes have circular cross-sectional shapes.

44. The duplexer of claim 41 where said holes have substantially parallel center axes.

45. The duplexer of claim 41 where said input-output pads are areas of conductive material substantially adjacent to said top surface of said filter body within said first uncoated area.

46. The duplexer of claim 41 where said third input-output pad is substantially adjacent to said third hole and positioned at a predetermined location between said first and second input-output pads such that said first and third input-output pads substantially couple signals through said first and third resonators thereby forming a first filter, said second and third input-output pads coupling signals substantially through said second and third resonators forming a second filter, said first and second filters having first and second center frequencies respectively.

47. The duplexer of claim 46 where said first center frequency is substantially equal to the center frequency of a radio communications device transmit frequency.

48. The duplexer of claim 46 where said second center frequency is substantially equal to the center frequency of a radio communications device receive frequency.

49. The duplexer of claim 46 where said third input-output pad is coupled to a source of radio communications signals.

* * * * *

UNITED STATES PATENT AND TRADEMARK OFFICE

CERTIFICATE OF CORRECTION

PATENT NO. : 5,146,193

DATED : September 8, 1992

INVENTOR(S) : Raymond L. Sokola

It is certified that error appears in the above-identified patent and that said Letters Patent is hereby corrected as shown below:

On the Title page and in col. 1, line 1:

Please delete the word "CORRECTIONS" in the title and insert thereat --CONNECTIONS--.

Signed and Sealed this

Twenty-first Day of September, 1993

Bruce Lehman

*Attest:*

BRUCE LEHMAN

*Attesting Officer*

*Commissioner of Patents and Trademarks*